US007198361B2

(12) United States Patent
Hida

(10) Patent No.: US 7,198,361 B2
(45) Date of Patent: Apr. 3, 2007

(54) INK JET APPARATUS

(75) Inventor: Shinichiro Hida, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 238 days.

(21) Appl. No.: 10/970,076

(22) Filed: Oct. 21, 2004

(65) Prior Publication Data

US 2005/0104943 A1 May 19, 2005

(30) Foreign Application Priority Data

Nov. 18, 2003 (JP) ..... 2003-388057

(51) Int. Cl.
*B41J 2/175* (2006.01)

(52) U.S. Cl. ..... 347/93

(58) Field of Classification Search ..... 347/85, 347/92, 93

See application file for complete search history.

(56) References Cited

U.S. PATENT DOCUMENTS 3,929,071 A 12/1975 Cialone et al.
4,357,617 A 11/1982 Shimazawa et al.
4,947,191 A * 8/1990 Nozawa et al. ..... 347/30
5,231,424 A * 7/1993 Kaneko et al. ..... 347/29
5,481,289 A * 1/1996 Arashima et al. ..... 347/93
5,751,300 A * 5/1998 Cowger et al. ..... 347/6
6,120,140 A * 9/2000 Hirosawa et al. ..... 347/93
6,152,559 A * 11/2000 Kojima ..... 347/89
6,217,164 B1 * 4/2001 Hino ..... 347/85
6,561,637 B2 * 5/2003 Hino ..... 347/92
6,715,863 B2 * 4/2004 Shimizu ..... 347/85
2003/0189625 A1 10/2003 Satou et al.

FOREIGN PATENT DOCUMENTS

JP 2001-105629 A 4/2001
JP 2001-171142 A 6/2001
JP 2003-019811 A 1/2003

* cited by examiner

*Primary Examiner*—Anh T. N. Vo
(74) *Attorney, Agent, or Firm*—Frishauf, Holtz, Goodman & Chick, P.C.

(57) ABSTRACT

An ink jet apparatus where a filter is provided in an ink inflow channel connecting an ink tank with the inside of an ink jet head to discharge ink from nozzles, and in an ink outflow channel connecting the inside of the ink jet head with the ink inflow channel. The ink passes through the inside of the ink jet head, and bubbles existing inside the ink jet head move with the ink to the outside. Further, as foreign materials are repeatedly removed from the ink, bubbles in the ink jet head can be removed with a simple construction and the occurrence of ink discharge failure can be reliably suppressed.

15 Claims, 6 Drawing Sheets

INK JET APPARATUS

CROSS REFERENCE OF THE RELATED APPLICATION

This application is based upon and claims the benefit of priority from the prior Japanese Application No. 2003-388057, filed on Nov. 18, 2003, the entire contents of which are incorporated herein by reference.

BACKGROUND OF THE INVENTION

1. Field of the Invention

The present invention relates to an ink jet apparatus which discharges ink as ink droplets.

2. Discussion of the Background

Conventionally, an ink jet apparatus such as an ink jet printer discharges ink in an ink jet head from nozzles as ink droplets, onto a printing medium, thereby performs image formation.

In this ink jet apparatus, the ink is supplied from an ink tank or the like to the ink jet head via an ink channel. When the ink contains foreign materials, clogging occurs in the nozzles of the ink jet head, which causes ink discharge failure. Accordingly, a filter for removal of foreign materials is provided in the ink channel, whereby the entrance of foreign materials contained in the ink into the ink jet head can be prevented.

On the other hand, as an ink tank, a removable ink cartridge or the like is employed. Upon change of the ink cartridge, when the ink cartridge is removed from the ink jet apparatus, the ink channel is opened to the atmosphere and bubbles may enter the ink channel. In such state, when the ink is supplied from the ink cartridge to the ink jet head, the bubbles move together with the ink to the ink jet head side. The bubbles may be captured with the filter and stay on it or may pass through the filter and enter the ink jet head. Then ink supply may be unstable due to the bubbles stay on the filter, and further, ink discharge failure may occur due to the bubbles in the ink jet head. This may become a factor of poor printing to a printing medium.

To solve this problem, proposed is a method for preventing entrance of bubbles in an ink jet head by providing a buffer tank in an ink channel connecting an ink tank to the ink jet head (Japanese Published Unexamined Patent Application No. 2003-19811).

Further, proposed is a method for automatically removing bubbles captured with a filter in an ink channel by shaping the ink channel to spread toward the filter (Japanese Published Unexamined Patent Application No. 2001-171142).

Further, proposed is a method for removing bubbles staying in an ink channel by idle-discharging ink between two nozzle suction operations in the ink jet head (Japanese Published Unexamined Patent Application No. 2001-105629). That is, the bubbles attached to and staying in the ink channel are made movable by ink idle discharging, and the bubbles are removed by the suction operation.

However, according to Japanese Published Unexamined Patent Application Nos. 2003-19811 and 2001-171142, since the entrance of bubbles in the ink jet head is prevented with the filter, once bubbles enter the ink jet head, the bubbles cannot be removed without difficulty.

Further, the entrance of bubbles in the ink jet head does not occur only by entrance of bubbles in the ink channel upon change of ink cartridge. That is, bubbles may be generated from air sucked from the nozzles due to change of temperature or atmospheric pressure or from dissolved gas in the ink, and enter the ink jet head. Accordingly, such bubbles cannot be removed without difficulty by the above techniques disclosed in Japanese Published Unexamined Patent Application Nos. 2003-19811 and 2001-171142. With regard to the technique in Japanese Published Unexamined Patent Application No. 2001-105629, it is possible to remove bubbles in the ink jet head, however, as a suction mechanism or the like to implement the suction operation is required, the apparatus is increased in size. Further, the control for the apparatus is complicated, and the cost is increased.

SUMMARY OF THE INVENTION

Accordingly, the present invention provides an ink jet apparatus which reliably suppresses the occurrence of ink discharge failure by removing bubbles in an ink jet head with a simple construction.

The object of the present invention is attained by providing novel ink jet recording apparatus and ink jet head according to the present invention.

The novel ink jet apparatus of the present invention comprises: an ink inflow channel connecting an ink container containing ink with the inside of an ink jet head to discharge ink from a nozzle as ink droplets; an inflow driving unit to cause the ink to flow into the ink jet head via the ink channel from the ink container; an ink outflow channel for making the inside of the ink jet head and the ink inflow channel communicate with each other; and filters provided in the ink inflow channel and in the ink outflow channel. The ink is made to pass through the inside of the ink jet head by driving of the inflow driving unit, thereby foreign materials can be repeatedly removed from the ink.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
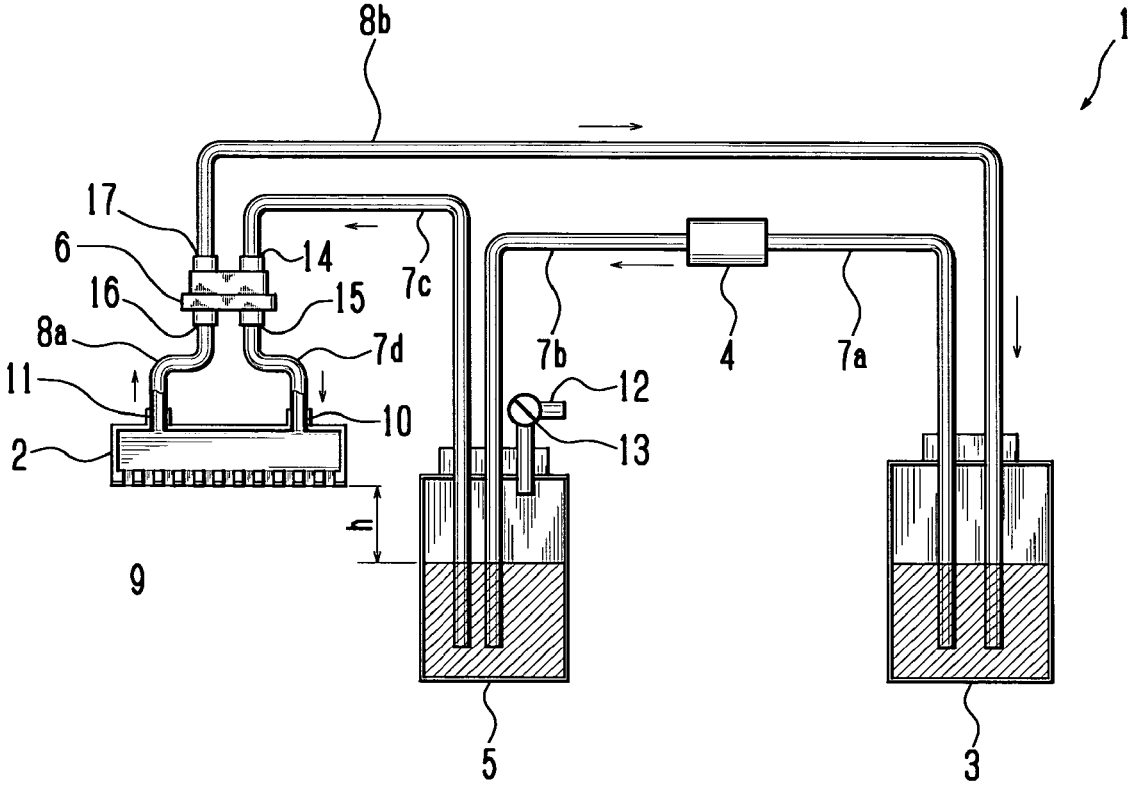
FIG. 1 is a cross sectional view schematically showing an ink channel in an ink jet apparatus according to a first embodiment of the present invention.
Figure 2:
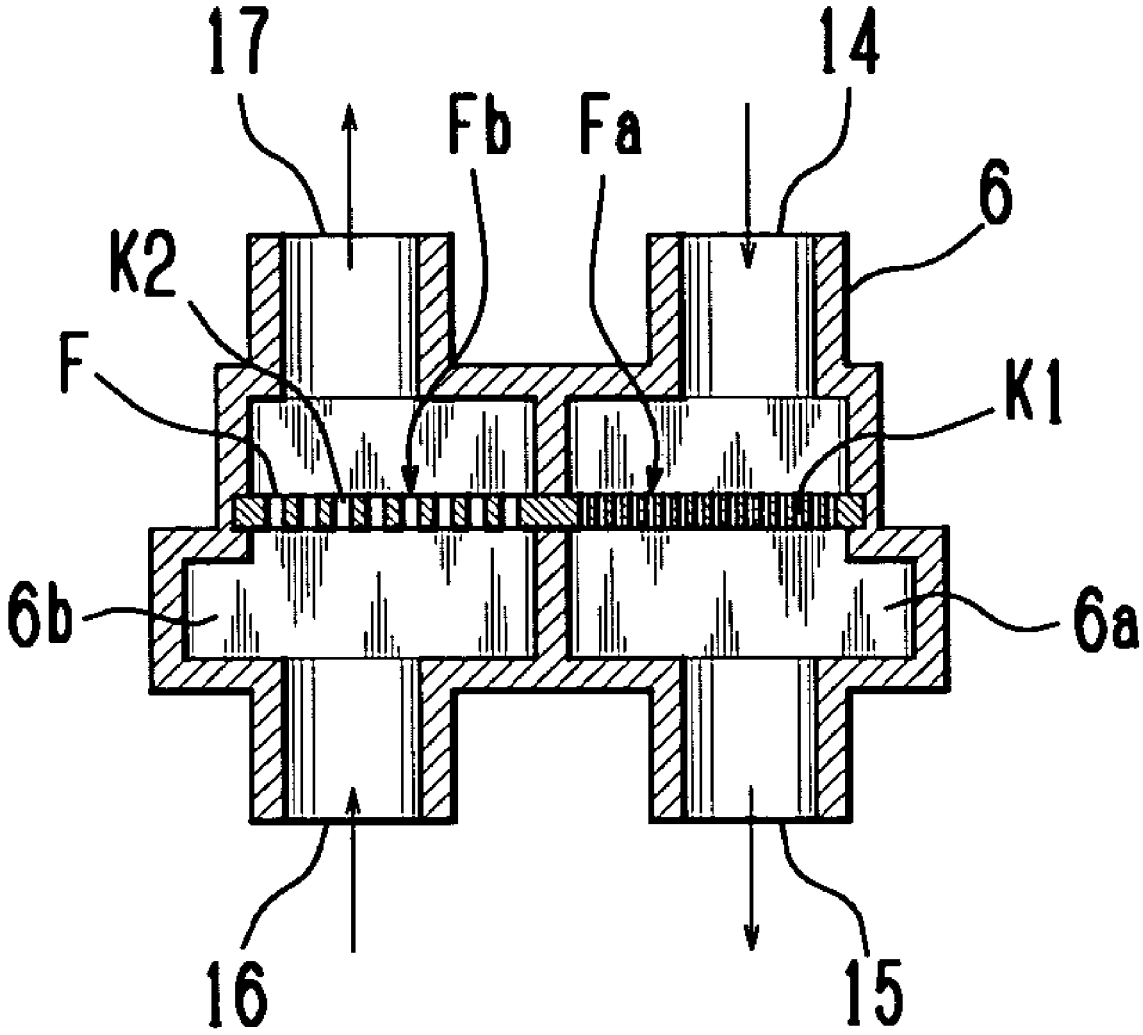
FIG. 2 is a longitudinal sectional view schematically showing the structure of a filter unit according to the first embodiment of the present invention.
Figure 3:
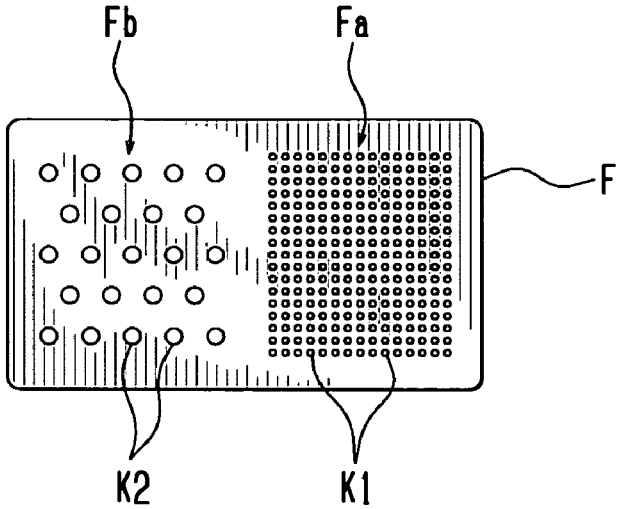
FIG. 3 is a plan view schematically showing a filter according to the first embodiment of the present invention.

A first embodiment of the present invention will be described with reference to FIGS. 1 to 4. FIG. 1 is a cross sectional view schematically showing an ink channel in an ink jet apparatus according to the first embodiment. FIG. 2 is a longitudinal sectional view schematically showing the structure of a filter unit. FIG. 3 is a plan view schematically showing a filter.

An ink jet apparatus 1 comprises an ink jet head 2, an ink tank 3, a liquid pump 4, an ink reservoir 5, a filter unit 6 and the like. These elements are connected through ink pipes 7*a* to 7*d*, and further, the ink jet head 2 and the ink tank 3 are connected via the filter unit 6 with ink pipes 8*a* and 8*b*. The ink pipes 7*a* to 7*d* and the ink reservoir 5 function as an ink inflow channel through which ink from the ink tank 3 to the ink jet head 2 flows, while the ink pipes 8*a* and 8*b* function as an ink outflow channel through which the ink moved out of the ink jet head 2 flows.

The ink tank 3 is an ink container containing ink supplied to the ink jet head 2. The liquid pump 4 is an inflow driving unit to cause ink to flow from the ink tank 3 into the ink jet head 2 via the ink pipes 7*a* to 7*d*, the ink reservoir 5 and the filter unit 6. That is, the ink in the ink tank 3 is supplied by the driving of the liquid pump 4 to the ink jet head 2 via the ink pipes 7*a* to 7*d*, the ink reservoir 5 and the filter unit 6.

The ink jet head 2 is arranged so as to hold the ink supplied from the ink tank 3 and discharge the ink from plural nozzles 9 communicating with the inside of the ink jet head as ink droplets. The ink jet head 2 comprises: an ink inflow port 10 which is connected to the ink pipe 7*d* and from which the ink flows in; and an ink outflow port 11 which is connected to the ink pipe 8*a* and from which the ink flowing in through the ink inflow port 10 and passing through the ink jet head 2 flows out. The ink passed through the filter unit 6 flows through the ink pipe 7*d* and enters the ink jet head 2 from the ink inflow port 10, passes through the ink jet head 2 and flows out from the ink outflow port 11. Note that the ink inflow port 10 and the ink outflow port 11 are provided in an upper part of the ink jet head 2 in positions close to both end sides of the ink jet head 2.

In the present embodiment, the ink jet head 2 is a piezoelectric type head utilizing a piezoelectric device (e.g. a piezo device), however, the present invention is not limited to this device. For example, a thermal ink-jet type ink jet head utilizing a heat generator may be employed.

The ink reservoir 5 is a portion in which the ink supplied by the liquid pump 4 is temporarily stored. The ink reservoir 5 is provided with an ambient air pipe 12 connecting the inside to the outside. The ambient air pipe 12 is provided with a switching valve 13 to switch the connection state between the inside and the outside. By the driving of the switching valve 13, a state where the inside and the outside of the ink reservoir 5 are connected, i.e., an open-air state or a state where the inside and the outside of the ink reservoir 5 are not connected, i.e., a non-open-air state is selected. The ink reservoir 5 applies negative pressure to the ink in the nozzles 9 by utilizing the water head difference "h" between the ink liquid surface inside the reservoir and the nozzles 9 of the ink jet head 2. The operation of the negative pressure prevents leakage of the ink from the nozzles 9.

The filter unit 6 includes a filter F for ink filtration (See FIG. 2). The filter F removes a particle of a predetermined size from the ink passing through inside. The filter F is integrally composed of e.g. an inflow filter Fa and an outflow filter Fb (See FIG. 3). Note that the filter F is arranged horizontally.

The inflow filter Fa has an area of plural through holes K1 having a predetermined hole diameter. The outflow filter Fb has an area of plural through holes K2 having a predetermined hole diameter greater than that of the through holes K1. That is, the through hole K2 of the outflow filter Fb is greater than the through hole K1 of the inflow filter Fa. The hole diameter of the through hole K2 is set to a size to easily pass a bubble. Further, the open area ratio of the inflow filter Fa is higher than that of the outflow filter Fb.

The resistant difference of the filter F against ink passage can be adjusted by changing the open area ratio and the hole diameters of the through holes K1 and K2. The difference of surface tension according to the difference of hole diameter and the difference of wettability of filter surface according to the difference of open area ratio influence the resistant difference. Note that the filter F has a rectangular outer shape, however, the present invention is not limited to this shape. For example, the filter may have a disk shape. Further, the inner wall of the filter unit 6 is formed in accordance with the shape of the filter F.

The filter unit 6 is provided with 2 ink distribution chambers 6*a* and 6*b* for the divided inflow filter Fa and outflow filter Fb of the filter F. The ink distribution chamber 6*a* is provided with an inflow opening 14 which is connected to the ink pipe 7*c* and which the ink supplied by the liquid pump 4 flows in, and an outflow opening 15 which is connected to the ink pipe 7*d* and from which the ink passed through the inflow filter Fa flows out. Further, the ink distribution chamber 6*b* is provided with an inflow opening 16 which is connected to the ink pipe 8*a* and which the ink moved from the ink jet head 2 flows in, and an outflow opening 17 which is connected to the ink pipe 8*b* and from which the ink passed through the outflow filter Fb flows out. Note that the ink distribution chamber 6*a* functions as an ink inflow channel, and the ink distribution chamber 6*b*, as an ink outflow channel.

The ink flowing in from the inflow opening 14 passes through the inflow filter Fa and flows out from the outflow opening 15. Similarly, the ink flowing in from the inflow opening 16 passes through the outflow filter Fb and flows out from the outflow opening 17. By this arrangement, the ink is filtered with the inflow filter Fa and the outflow filter Fb, thereby foreign materials which cause clogging in the nozzles 9 and small particles which become cores of bubbles generated in the ink jet head 2 can be reliably removed.

Figure 4:
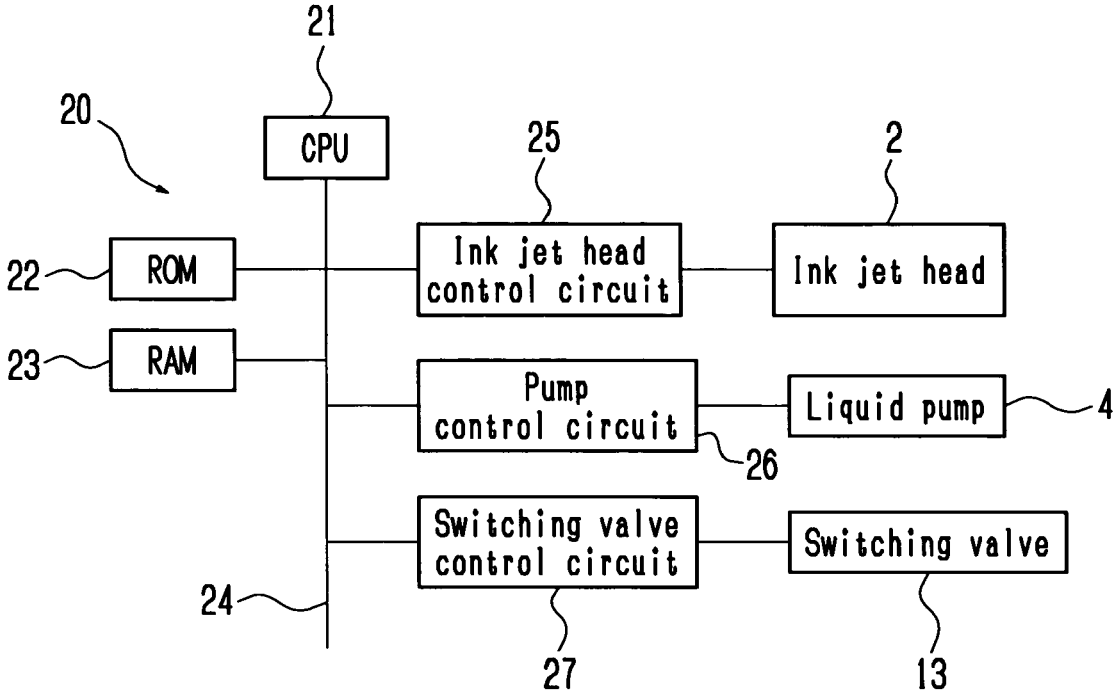
FIG. 4 is a block diagram schematically showing electrical connection among respective elements of the ink jet apparatus according to the first embodiment of the present invention.

FIG. 4 is a block diagram schematically showing electrical connection among respective elements of the ink jet apparatus. The ink jet apparatus 1 has a controller 20. The controller 20 includes a CPU (Central Processing Unit) 21 which controls the respective elements in a concentrated manner, a ROM (Read Only Memory) 22 in which various programs executed by the CPU 21 and the like are stored, and a RAM (Random Access Memory) 23 which functions as a work area for the CPU 21. They are connected via a bus line 24. Further, the CPU 21 is connected to the ink jet head 2 via an ink jet head control circuit 25, to the liquid pump 4 via a pump control circuit 26, and to the switching valve 13 via a switching valve control circuit 27.

Next, an operation of the ink jet apparatus 1 having the above construction upon filling the ink jet head 2 with ink from the ink tank 3 will be described. First, the ink jet apparatus 1 sets the ink reservoir 5 to the non-open-air state by drive-controlling the switching valve 13. Next, in an initial filling operation, for example, the ink is caused to flow slowly at a low speed not so as to accumulate air around inner corners of the ink jet head 2 and so as to attain uniform wettability by drive-controlling the liquid pump 4. After a predetermined period, e.g., after the ink has circulated through the ink channel once, in an ink circulation operation, the ink is caused to flow at a high speed by drive-controlling the liquid pump 4, so as to move bubbles staying inside the ink jet head 2 out. Note that the liquid pump 4 is drive-controlled to prevent leakage of ink from the nozzles 9 of the ink jet head 2.

At this time, the ink in the ink tank 3 passes through the ink pipes 7*a* to 7*d*, the ink reservoir 5 and the filter unit 6 by the driving of the liquid pump 4, and enters the ink jet head 2 from the ink inflow port 10. The ink passes through the ink distribution chamber 6*a* of the filter unit 6 and is filtered with the inflow filter Fa, thus foreign materials are removed from the ink. The ink entered the ink jet head 2 passes through the ink jet head 2, flows out from the ink outflow port 11, flows through the ink pipes 8*a*, 8*b* and the filter unit 6, and flows into the ink tank 3. As the ink passes through the ink distribution chamber 6*b* of the filter unit 6, it is filtered with the outflow filter Fb, thus foreign materials are removed from the ink.

Thereafter, the ink in the ink tank 3 again flows through the ink pipes 7*a* to 7*d*, the ink reservoir 5 and the filter unit 6, and enters the ink jet head 2 from the ink inflow port 10. In this manner, the ink supplied from the ink tank 3 circulates the ink channel including the inside of the ink jet head 2. Note that the ink that entered the ink jet head 2 flows almost end to end inside the ink jet head 2.

As the ink flows through the inside of the ink jet head 2 in this manner, bubbles existing in the ink jet head 2 are moved with the ink to the outside. Thus the bubbles existing in the ink jet head 2 can be removed and the occurrence of ink discharge failure can be reliably suppressed with a simple construction. Further, as the ink is circulated, the consumption of ink can be suppressed and the cost can be reduced. Further, as the inflow filter Fa for ink filtration is provided in the ink pipes 7*c* and 7*d* and the outflow filter Fb for ink filtration is provided in the ink pipes 8*a* and 8*b*, the ink flowing through the ink pipes 7*a* to 7*d*, 8*a* and 8*b* can be repeatedly filtered, thereby foreign materials can be more reliably removed from the ink.

Further, in the present embodiment, as the ink pipes 8*a* and 8*b* as an ink outflow channel communicate with the ink pipes 7*a* to 7*d* on the upstream side of the filter F, the ink passes the filter F repeatedly, thereby foreign materials can be reliably removed from the ink.

Further, in the present embodiment, as the ink pipes 8*a* and 8*b* are connected to the ink tank 3 so as to communicate with the ink pipes 7*a* to 7*d*, the occurrence of ink discharge failure can be reliably suppressed with a simple construction.

Further, in the present embodiment, the filter unit 6 is provided which includes the ink distribution chamber 6*a* to function as an ink inflow channel and the ink distribution chamber 6*b* to function as an ink outflow channel. The inflow filter Fa is provided in the ink distribution chamber 6*a* to function as an ink inflow channel, and the outflow filter Fb is provided in the ink distribution chamber 6*b* to function as an ink outflow channel. Accordingly, the filters Fa and Fb can be easily attached/removed.

Figure 6:
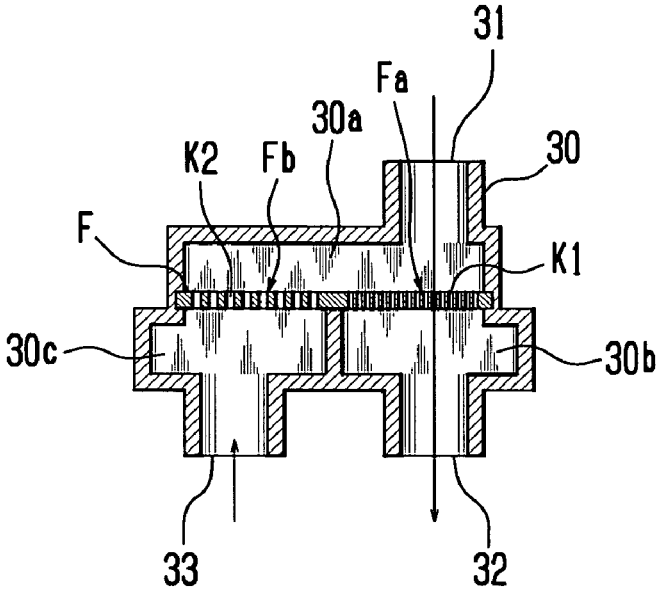
FIG. 6 is a longitudinal sectional view schematically showing the structure of the filter unit according to the second embodiment of the present invention.
Figure 5:
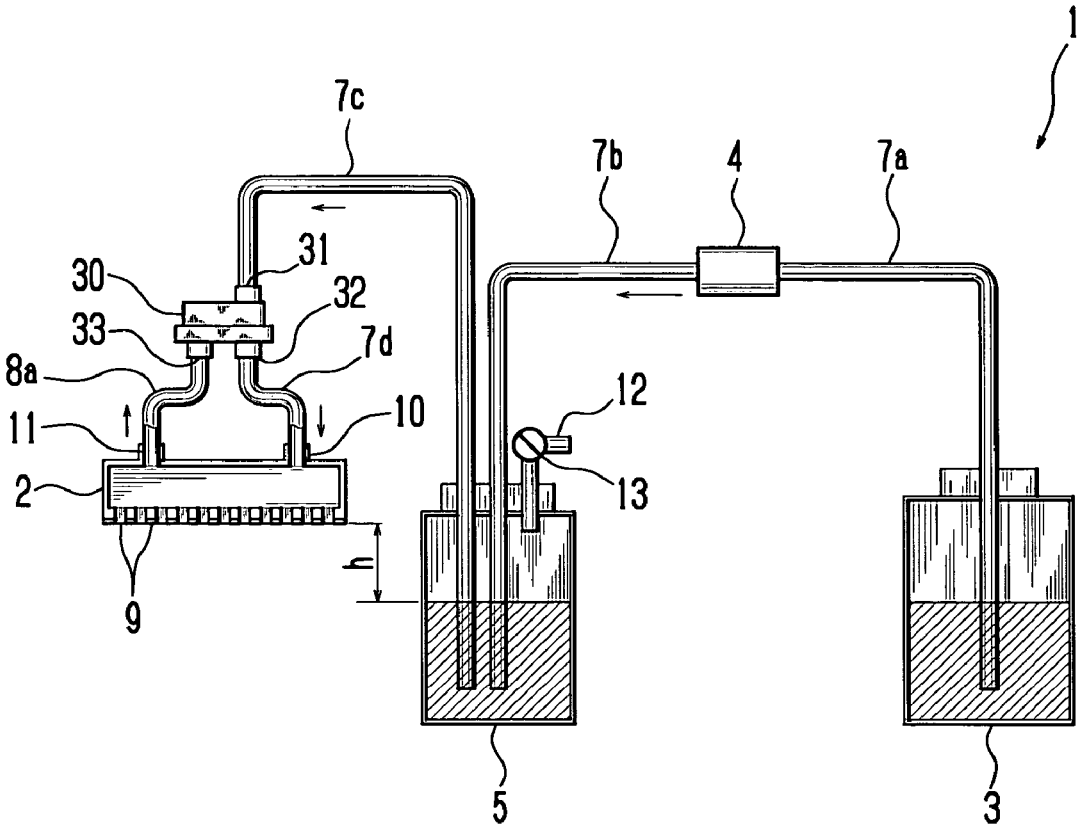
FIG. 5 is a cross sectional view schematically showing the ink channel in the ink jet apparatus according to a second embodiment of the present invention.

Next, a second embodiment of the present invention will be described with reference to FIGS. 5 and 6. FIG. 5 is a cross sectional view schematically showing the ink channel in the ink jet apparatus. FIG. 6 is a longitudinal sectional view schematically showing the structure of the filter unit.

As the basic construction of the present embodiment is approximately the same as that of the first embodiment, only the difference from the first embodiment will be described. Note that the same elements have the same reference numerals and explanations thereof will be omitted.

A filter unit 30 has an ink distribution chamber 30*a* a part of which is the filter F, an ink distribution chamber 30*b* a part of which is the inflow filter Fa and which opposes the ink distribution chamber 30*a* via the inflow filter Fa, and an ink distribution chamber 30*c* a part of which is the outflow filter Fb and which opposes the ink distribution chamber 30*a* via the outflow filter Fb. Note that the ink distribution chambers 30*a* and 30*b* function as an ink inflow channel through which the ink from the ink tank 3 to the ink jet head 2 flows, and the ink distribution chambers 30*a* and 30*c* function as an ink outflow channel through which the ink from the ink jet head 2 flows.

The ink distribution chamber 30*a* is provided with an inflow opening 31 which is connected to the ink pipe 7*c* and which the ink supplied by the liquid pump 4 flows in. The inflow opening 31 is provided in a position opposite to the inflow filter Fa. As the ink entered from the inflow opening 31 flows toward the inflow filter Fa, it is prevented from flowing to the outflow filter Fb side. The ink distribution chamber 30*b* is provided with an outflow opening 32 which is connected to the ink pipe 7*d* and which the ink passed through the inflow filter Fa flows out. Further, the ink distribution chamber 30*c* is provided with an inflow opening 33 which is connected to the ink pipe 8*a* and which the ink from the ink jet head 2 flows in.

Next, an operation of the ink jet apparatus 1 having the above construction upon filling the ink jet head 2 with ink from the ink tank 3 will be described. First, the ink jet apparatus 1 sets the ink reservoir 5 to the non-open-air state by drive-controlling the switching valve 13. Next, in an initial filling operation, for example, the ink is caused to flow slowly at a low speed not so as to accumulate air around inner corners of the ink jet head 2 and so as to attain uniform wettability by drive-controlling the liquid pump 4. After a predetermined period, e.g., after the ink has circulated through the ink channel once, in an ink circulation operation, the ink is caused to flow at a high speed by drive-controlling the liquid pump 4, so as to move bubbles staying inside the ink jet head 2 out. Note that the liquid pump 4 is drive-controlled to prevent leakage of ink from the nozzles 9 of the ink jet head 2.

At this time, the ink in the ink tank 3 passes, by the driving of the liquid pump 4, through the ink pipes 7*a* to 7*d*, the ink reservoir 5 and the filter unit 30, and enters the ink jet head 2 from the ink inflow port 10. The ink entered from the inflow opening 31 of the filter unit 30 in the ink distribution chamber 30*a* passes through the inflow filter Fa forming a part of the ink distribution chamber 30*a*, then passes through the ink distribution chamber 30*b*, and flows out from the outflow opening 32. At this time, the ink is filtered with the inflow filter Fa, thus foreign materials are removed from the ink. Note that since the outflow filter Fb has low wettability, the ink entered the ink distribution chamber 30*a* passes through the inflow filter Fa almost without flowing to the outflow filter Fb side.

The ink flowing in the ink jet head 2 passes through the ink jet head 2, flows out from the ink outflow port 11, flows through the ink pipes 8*a*, and flows in the ink distribution chamber 30*c* of the filter unit 30 from the inflow opening 33. The ink flowing in the ink distribution chamber 30*c* from the inflow opening 33 passes through the outflow filter Fb, and flows in the ink distribution chamber 30*a*. Then the ink entered the ink distribution chamber 30*a* again passes through the inflow filter Fa and the ink distribution chamber 30*b*, flows through the ink pipe 7*d*, and enters the ink jet head 2 from the ink inflow port 10. In this manner, the ink supplied from the ink tank 3 circulates the ink channel including the inside of the ink jet head 2. Note that the ink that entered the ink jet head 2 flows almost end to end inside the ink jet head 2.

As the ink flows through the inside of the ink jet head 2 in this manner, bubbles existing in the ink jet head 2 are moved with the ink to the outside. Thus the bubbles existing in the ink jet head 2 can be removed and the occurrence of ink discharge failure can be reliably suppressed with a simple construction. Further, as the ink is circulated, the consumption of ink can be suppressed and the cost can be reduced. Note that the present embodiment has the same advantages as those of the first embodiment.

Further, in the present embodiment, the filter unit 30 is provided which include therein the ink distribution chambers 30*a* and 30*b* which function as an ink inflow channel and the ink distribution chamber 30*c* connected to the ink distribution chamber 30*a* to function as an ink outflow channel. The inflow filter Fa is provided in the ink distribution chambers 30*a* and 30*b* which function as an ink inflow channel and the outflow filter Fb is provided in the ink distribution chamber 30*c* which functions as an ink outflow channel. Accordingly, the filters Fa and Fb can be easily attached/removed.

Figure 7:
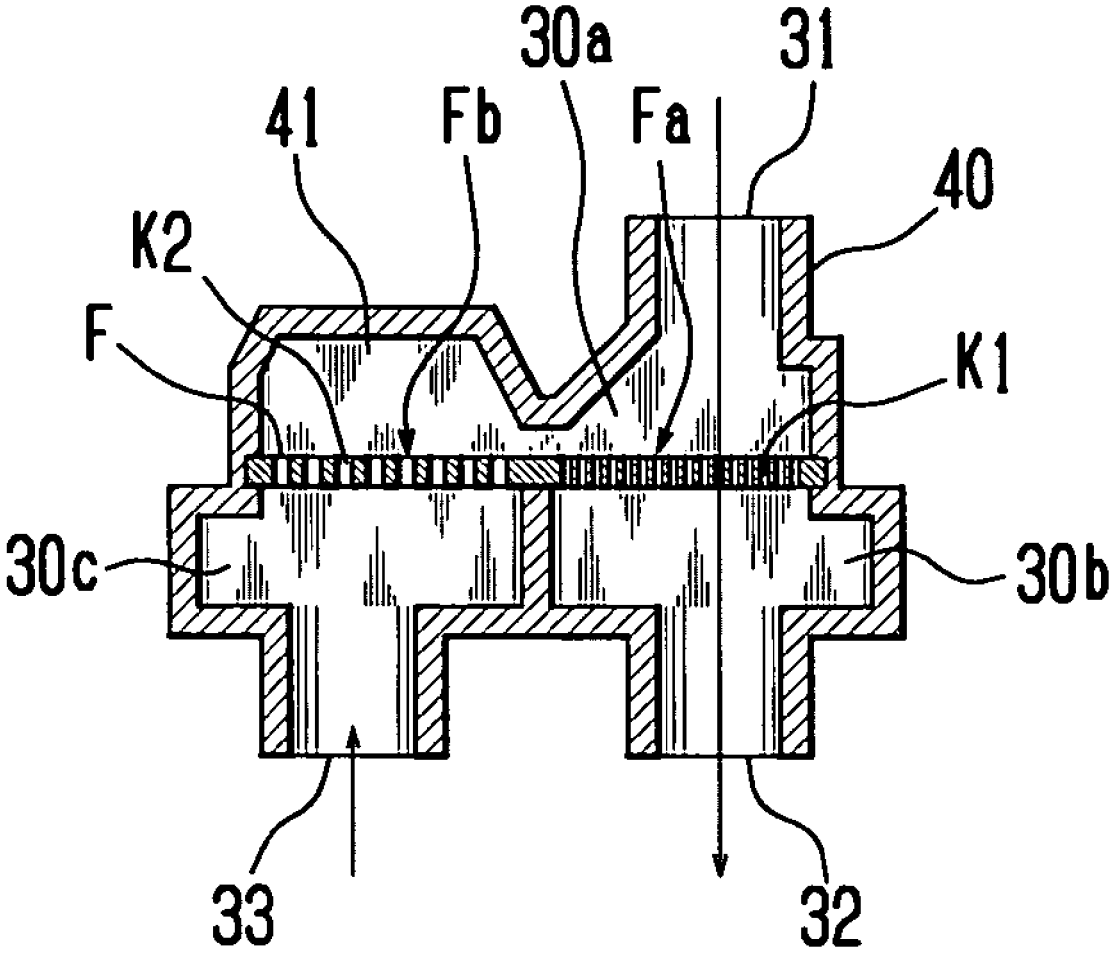
FIG. 7 is a longitudinal sectional view schematically showing the structure of the filter unit according to a third embodiment of the present invention.

Next, a third embodiment of the present invention will be described with reference to FIG. 7. FIG. 7 is a longitudinal sectional view schematically showing the structure of the filter unit.

As the basic construction of the present embodiment is approximately the same as that of the second embodiment, only the difference from the second embodiment will be described. Note that the same elements have the same reference numerals and explanations thereof will be omitted.

A filter unit 40 has a bubble chamber 41 in which bubbles passed through the outflow filter Fb are stored. The bubble chamber 41 is provided in an upper part of the filter unit 40 in a position above the outflow filter Fb. The filter unit 40 may be provided with a bubble removal mechanism (not shown) to discharge the bubbles, i.e., air gas, stored in the bubble chamber 41 to the outside. The bubble removal mechanism may be constituted of e.g. a pipe connecting the filter unit 40 and its outside to each other, a switching valve to switch the pipe connection state, and the like.

In the above construction, when the ink passes through the ink jet head 2 and enters the ink distribution chamber 30*c* of the filter unit 40, as in the case of the second embodiment, bubbles existing in the ink jet head 2 enter the ink distribution chamber 30*c* of the filter unit 40 with the ink, pass through the outflow filter Fb and move to the bubble chamber 41. When the ink circulates inside the ink jet head 2, bubbles are gradually stored in the bubble chamber 41. In this manner, as bubbles can be stored in one portion, the bubbles can be prevented from spreading, and the ink can be supplied in a stable manner. Note that in a case where the filter unit 40 is provided with the bubble removal mechanism, the bubbles stored in the bubble chamber 41, i.e., the air, can be discharged to the outside of the filter unit 40 at predetermined timing by the bubble removal mechanism. Further, the present embodiment has the same advantages as those of the second embodiment.

Note that in the respective embodiments, as the inflow filter Fa has plural through holes K1 and the outflow filter Fb has plural through holes K2, foreign materials can be reliably removed from the ink, and further, the characteristics of the filters Fa and Fb can be easily changed by changing the hole diameters of the through holes K1 and K2.

Further, in the respective embodiments, as the hold diameter of the through hole K1 of the inflow filter Fa is smaller than that of the through hole K2 of the outflow filter Fb and the open area ratio of the inflow filter Fa is higher than that of the outflow filter Fb, foreign materials can be excellently removed form the ink with filter Fa, and further, bubbles move from the ink jet head 2 can excellently pass through the outflow filter Fb.

Further, in the respective embodiments, as the filter F is positioned above the ink jet head 2, bubbles staying inside the ink jet head 2 move to the outside of the ink jet head 2 not only by the pressing force by the ink but also by their buoyancy. Accordingly, bubbles existing in the ink jet head 2 can be more reliably removed.

Further, in the respective embodiments, as the inflow filter Fa and the outflow filter Fb are integrally formed as the filter F, the cost can be reduced in comparison with a case where the filters Fa and Fb are respectively provided in the ink pipes 7*a* to 7*d*, and in the ink pipes 8*a* and 8*b*. Further, the attachment work of the filter F to the filter unit 6 can be simplified.

Note that in the respective embodiments, the filter F is horizontally provided, however, the present invention is not limited to this position. For example, the filter F may be slanted to a horizontal plane. In this case, bubbles move from the ink jet head 2 can be guided to and collected in a part of the periphery of the filter F. Accordingly, the bubbles can be prevented from spreading, and the ink can be supplied in a stable manner.

Obviously, numerous modifications and variations of the present invention are possible in light of the above teachings. It is therefore to be understood that within the scope of appended claims, the invention may be practiced otherwise than as specifically described herein.

What is claimed is:

1. An ink jet apparatus, comprising:

an ink container which contains ink;

an ink jet head which contains ink supplied thereto, and which discharges the ink as ink droplets from at least one nozzle communicating with an inside of the ink jet head;

an ink inflow channel via which the ink container and the inside of the ink jet head communicate with each other, and through which the ink is supplied to the ink jet head from the ink container;

an inflow driving unit which causes the ink from the ink container to enter the ink jet head via the ink inflow channel;

an inflow filter which is provided in the ink inflow channel, and which filters the ink;

an ink outflow channel through which the ink flows out from the ink jet head; and an outflow filter which is provided in the ink outflow channel, and which filters the ink;

wherein the inflow filter comprises a plurality of through holes, and the outflow filter comprises a plurality of through holes; and wherein each of the through holes of the inflow filter is smaller than each of the through holes of the outflow filter, and the inflow filter has an open area ratio that is higher than an open area ratio of the outflow filter.

2. An ink jet apparatus according to claim 1, wherein the ink outflow channel communicates with the ink inflow channel on an upstream side of the inflow filter, and wherein the upstream side is upstream in a direction of ink flowing toward the ink jet head.

3. An ink jet apparatus according to claim 2, wherein the ink outflow channel is connected to the ink container.

4. An ink jet apparatus according to claim 1, further comprising:

a filter unit which includes therein a first ink distribution chamber to function as the ink inflow channel and a second ink distribution chamber to function as the ink outflow channel;

wherein the inflow filter is provided in the first ink distribution chamber, and the outflow filter is provided in the second ink distribution chamber.

5. An ink jet apparatus according to claim 4, wherein the inflow filter and the outflow filter are integrally formed.

6. An ink jet apparatus according to claim 1, further comprising:

a filter unit which includes therein a first ink distribution chamber to function as the ink inflow channel and a second ink distribution chamber to function as the ink outflow channel;

wherein the first ink distribution chamber communicates with the second ink distribution chamber; and wherein the inflow filter is provided in the first ink distribution chamber, and the outflow filter is provided in the second ink distribution chamber.

7. An ink jet apparatus according to claim 6, wherein the filter unit includes a bubble chamber in which bubbles that pass through the outflow filter are stored.

8. An ink jet apparatus according to claim 6, wherein the inflow filter and the outflow filter are integrally formed.

9. An ink jet apparatus according to claim 1, wherein the inflow filter and the outflow filter are positioned above the ink jet head.

10. An ink jet apparatus according to claim 1, wherein the inflow filter and the outflow filter are integrally formed.

11. An ink jet apparatus, comprising:

an ink container which contains ink;

an ink jet head which contains ink supplied thereto, and which discharges the ink as ink droplets from at least one nozzle communicating with an inside of the ink jet head;

an ink inflow channel via which the ink container and the inside of the ink jet head communicate with each other, and through which the ink is supplied to the ink jet head from the ink container;

an inflow driving unit which causes the ink from the ink container to enter the ink jet head via the ink inflow channel;

an inflow filter which is provided in the ink inflow channel, and which filters the ink;

an ink outflow channel through which the ink flows out from the ink jet head; and an outflow filter which is provided in the ink outflow channel, and which filters the ink;

wherein the ink outflow channel communicates with the ink inflow channel on an upstream side of the inflow filter, and wherein the upstream side is upstream in a direction of ink flowing toward the ink jet head.

12. An ink jet apparatus according to claim 11, wherein the ink outflow channel is connected to the ink container.

13. An ink jet apparatus, comprising:

an ink container which contains ink;

an ink jet head which contains ink supplied thereto, and which discharges the ink as ink droplets from at least one nozzle communicating with an inside of the ink jet head;

a filter unit which includes therein: (i) a first ink distribution chamber to function as an ink inflow channel via which the ink container and the inside of the ink jet head communicate with each other, and through which the ink is supplied to the ink jet head from the ink container, and (ii) a second ink distribution chamber to function as an ink outflow channel through which the ink flows out from the ink jet head, wherein the first ink distribution chamber communicates with the second ink distribution chamber;

an inflow driving unit which causes the ink from the ink container to enter the ink jet head via the ink inflow channel;

an inflow filter which is provided in the first ink distribution chamber, and which filters the ink;

an outflow filter which is provided in the second ink distribution chamber, and which filters the ink.

14. An ink jet apparatus according to claim 13, wherein the filter unit includes a bubble chamber in which bubbles that pass through the outflow filter are stored.

15. An ink jet apparatus according to claim 13, wherein the inflow filter and the outflow filter are integrally formed.

* * * * *